US007516698B2

(12) United States Patent
Gentle et al.

(10) Patent No.: US 7,516,698 B2
(45) Date of Patent: Apr. 14, 2009

(54) WEB OFFSET PRINTING PRESS WITH AUTOPLATING

(75) Inventors: Brian Joseph Gentle, Rochester, NH (US); Matt Alan Taylor, Barrington, NH (US); Bryan Charles Dustin, Strafford, NH (US); Keith Andrew Cornish, Rochester, NH (US)

(73) Assignee: Goss International Americasn, Inc., Durham, NH (US)

( * ) Notice: Subject to any disclaimer, the term of this patent is extended or adjusted under 35 U.S.C. 154(b) by 0 days.

(21) Appl. No.: 11/388,601

(22) Filed: Mar. 24, 2006

(65) Prior Publication Data

US 2006/0219115 A1 Oct. 5, 2006

Related U.S. Application Data

(60) Provisional application No. 60/666,360, filed on Mar. 30, 2005.

(51) Int. Cl.

| | |
|---|---|
| ***B41F 13/14*** | (2006.01) |
| ***B41F 13/34*** | (2006.01) |
| ***B41F 13/36*** | (2006.01) |
| ***B41F 27/00*** | (2006.01) |
| ***B41F 27/12*** | (2006.01) |
| ***B41F 27/06*** | (2006.01) |

(52) U.S. Cl. ..... 101/218; 101/477; 101/220; 101/219; 101/483

(58) Field of Classification Search ..... 101/247
See application file for complete search history.

(56) References Cited

U.S. PATENT DOCUMENTS

| | | | | |
|---|---|---|---|---|
| 2,172,364 A | | 9/1939 | De Manna | 271/80 |
| 3,527,165 A | | 9/1970 | Harless | 101/143 |
| 4,240,346 A | | 12/1980 | Landis et al. | 101/139 |
| 4,458,591 A | | 7/1984 | Guaraldi | 101/247 |
| 4,620,480 A | | 11/1986 | Hermach | 101/179 |
| 4,643,090 A | * | 2/1987 | McKrell et al. | 101/218 |
| 4,677,911 A | | 7/1987 | Hermach | 101/218 |
| 4,807,527 A | | 2/1989 | Knauer | 101/216 |
| 4,823,693 A | | 4/1989 | Kobler | 101/218 |

(Continued)

FOREIGN PATENT DOCUMENTS

| | | |
|---|---|---|
| DE | 2046131 | 3/1972 |

(Continued)

OTHER PUBLICATIONS

Mike Thompson, Sunday 2000—Auto Transfer "Zero Makeready Format" WOA Conference, Nashville, TN May 7, 2003, pp. 1-14.

(Continued)

*Primary Examiner*—Daniel J Colilla
(74) *Attorney, Agent, or Firm*—Davidson, Davidson & Kappel, LLC

(57) ABSTRACT

An offset web print unit includes a plate cylinder, a blanket cylinder, a second blanket cylinder, an autoplating mechanism, and a throw-off mechanism including a single actuator both for moving the blanket cylinder from the second blanket cylinder and for moving the blanket cylinder to selectively contact the plate cylinder to permit autoplating while the blanket cylinder is thrown-off of the second blanket cylinder. Methods are also provided.

19 Claims, 9 Drawing Sheets

U.S. PATENT DOCUMENTS

| | | | | | |
|---|---|---|---|---|---|
| 4,831,926 | A | | 5/1989 | Bowman et al. | 101/138 |
| 4,875,936 | A | | 10/1989 | Hermach | 101/218 |
| 4,913,048 | A | | 4/1990 | Tittgemeyer | 101/141 |
| 4,932,321 | A | | 6/1990 | Hermach | 101/211 |
| 4,934,265 | A | | 6/1990 | Knauer | 101/177 |
| 5,003,889 | A | | 4/1991 | Glunz et al. | 101/228 |
| 5,005,475 | A | | 4/1991 | Knauer | 101/218 |
| 5,042,788 | A | | 8/1991 | Bowman et al. | 270/21.1 |
| RE33,944 | E | | 6/1992 | Knauer | 101/216 |
| 5,161,463 | A | | 11/1992 | Knauer et al. | 101/220 |
| 5,237,920 | A | | 8/1993 | Guaraldi | 101/216 |
| 5,241,905 | A | | 9/1993 | Guaraldi et al. | 101/216 |
| 5,245,923 | A | | 9/1993 | Vrotacoe | 101/217 |
| 5,289,770 | A | | 3/1994 | Hern | 101/226 |
| 5,301,609 | A | * | 4/1994 | Guaraldi et al. | 101/216 |
| 5,304,267 | A | | 4/1994 | Vrotacoe et al. | 156/86 |
| 5,316,798 | A | | 5/1994 | Tittgemeyer | 427/409 |
| 5,323,702 | A | | 6/1994 | Vrotacoe et al. | 101/217 |
| 5,337,664 | A | * | 8/1994 | Hannon | 101/218 |
| 5,394,797 | A | | 3/1995 | Dobler et al. | 101/216 |
| 5,415,092 | A | | 5/1995 | Hern | 101/226 |
| RE34,970 | E | | 6/1995 | Tittgemeyer | 101/141 |
| 5,421,260 | A | | 6/1995 | Dobler | 101/247 |
| 5,429,048 | A | | 7/1995 | Gaffney et al. | 101/217 |
| 5,440,981 | A | | 8/1995 | Vrotacoe et al. | 101/217 |
| 5,445,076 | A | * | 8/1995 | Sugiyama et al. | 101/218 |
| 5,481,972 | A | | 1/1996 | Schmid | 101/216 |
| 5,488,903 | A | | 2/1996 | Koebler et al. | 101/375 |
| 5,492,062 | A | | 2/1996 | Harris et al. | 101/486 |
| 5,505,127 | A | | 4/1996 | Knauer | 101/218 |
| 5,522,316 | A | | 6/1996 | Singler | 101/479 |
| 5,524,539 | A | | 6/1996 | Doebler | 101/247 |
| 5,535,674 | A | | 7/1996 | Vrotacoe et al. | 101/216 |
| 5,535,675 | A | | 7/1996 | Gentle | 101/248 |
| 5,546,859 | A | | 8/1996 | Hern | 101/226 |
| 5,553,541 | A | | 9/1996 | Vrotacoe et al. | 101/217 |
| 5,560,292 | A | | 10/1996 | Knauer | 101/216 |
| 5,595,115 | A | | 1/1997 | Rau et al. | 101/142 |
| 5,595,119 | A | * | 1/1997 | Hada et al. | 101/477 |
| 5,651,314 | A | | 7/1997 | Gentle | 101/248 |
| 5,653,428 | A | | 8/1997 | Dufour et al. | 270/6 |
| 5,671,636 | A | | 9/1997 | Gagne et al. | 74/409 |
| 5,678,485 | A | | 10/1997 | Guaraldi | 101/247 |
| RE35,646 | E | | 11/1997 | Guaraldi et al. | 101/216 |
| 5,683,202 | A | | 11/1997 | Hummel et al. | 403/325 |
| 5,699,735 | A | | 12/1997 | Stein et al. | 101/219 |
| 5,722,323 | A | * | 3/1998 | Whiting et al. | 101/218 |
| 5,746,132 | A | | 5/1998 | Parks et al. | 101/483 |
| 5,768,990 | A | | 6/1998 | Vrotacoe et al. | 101/217 |
| 5,771,804 | A | | 6/1998 | Knauer et al. | 101/183 |
| 5,782,182 | A | | 7/1998 | Ruckmann et al. | 101/177 |
| 5,794,529 | A | | 8/1998 | Dawley et al. | 101/216 |
| 5,802,975 | A | | 9/1998 | Prem et al. | 101/375 |
| 5,813,336 | A | | 9/1998 | Guaraldi et al. | 101/218 |
| 5,832,821 | A | | 11/1998 | Petersen et al. | 101/216 |
| 5,894,796 | A | | 4/1999 | Gelinas | 101/219 |
| 5,901,648 | A | * | 5/1999 | Roland et al. | 101/218 |
| 5,960,714 | A | | 10/1999 | Goettling et al. | 101/216 |
| 5,970,870 | A | | 10/1999 | Shiba et al. | 101/137 |
| 5,979,371 | A | | 11/1999 | Lewis | 122/494 |
| 6,019,039 | A | | 2/2000 | Knauer et al. | 101/218 |
| 6,032,579 | A | | 3/2000 | Richards | 101/219 |
| 6,038,975 | A | | 3/2000 | Hoffmann et al. | 101/375 |
| 6,041,707 | A | | 3/2000 | Petersen et al. | 101/232 |
| 6,050,185 | A | | 4/2000 | Richards | 101/142 |
| 6,050,190 | A | | 4/2000 | Knauer et al. | 101/216 |
| 6,053,105 | A | | 4/2000 | Rudzewitz | 101/477 |
| 6,082,724 | A | | 7/2000 | Kahlig et al. | 270/52.14 |
| 6,085,651 | A | | 7/2000 | Defrance et al. | 101/247 |
| 6,093,139 | A | | 7/2000 | Belanger | 493/353 |
| 6,109,180 | A | | 8/2000 | Guaraldi et al. | 101/466 |
| 6,148,684 | A | | 11/2000 | Gardiner | 74/440 |
| 6,175,775 | B1 | | 1/2001 | Grunder | 700/111 |
| 6,186,064 | B1 | | 2/2001 | Dufour | 101/181 |
| 6,205,926 | B1 | | 3/2001 | Dufour | 101/492 |
| 6,216,592 | B1 | | 4/2001 | Knauer et al. | 101/247 |
| 6,227,110 | B1 | | 5/2001 | Zlatin | 101/218 |
| 6,227,111 | B1 | | 5/2001 | Dawley et al. | 101/218 |
| 6,289,805 | B1 | | 9/2001 | Douillard et al. | 101/247 |
| 6,343,547 | B1 | | 2/2002 | Callahan et al. | 101/216 |
| 6,345,574 | B1 | | 2/2002 | Charette et al. | 101/180 |
| 6,360,664 | B1 | | 3/2002 | Goettling et al. | 101/481 |
| 6,374,731 | B1 | | 4/2002 | Walczak et al. | 101/142 |
| 6,374,734 | B1 | | 4/2002 | Gaffney et al. | 101/376 |
| 6,386,100 | B1 | | 5/2002 | Gaffney et al. | 101/142 |
| 6,397,743 | B1 | | 6/2002 | Dauer et al. | 101/220 |
| 6,397,751 | B1 | | 6/2002 | Ramsay | 101/477 |
| 6,460,457 | B1 | * | 10/2002 | Ramsay | 101/477 |
| 6,494,135 | B1 | | 12/2002 | Goettling et al. | 101/213 |
| 6,494,138 | B1 | | 12/2002 | Goettling et al. | 101/479 |
| 6,520,083 | B2 | | 2/2003 | Petersen et al. | 101/401.1 |
| 6,526,888 | B2 | | 3/2003 | Douillard et al. | 101/484 |
| 6,543,352 | B1 | | 4/2003 | Dilling et al. | 101/220 |
| 6,553,908 | B1 | | 4/2003 | Richards et al. | 101/248 |
| 6,557,467 | B1 | | 5/2003 | Dilling et al. | 101/220 |
| 6,615,726 | B2 | | 9/2003 | Douillard et al. | 101/483 |
| 6,647,876 | B2 | | 11/2003 | Emery et al. | 101/247 |
| 6,668,721 | B2 | * | 12/2003 | Naka | 101/218 |
| 6,739,251 | B2 | | 5/2004 | Gaffney et al. | 101/217 |
| 6,814,003 | B2 | * | 11/2004 | Tobe et al. | 101/477 |
| 6,820,547 | B2 | | 11/2004 | Fujiwara | 101/218 |
| 6,937,751 | B2 | | 8/2005 | Ritt et al. | 382/132 |
| 6,966,258 | B2 | | 11/2005 | Charette et al. | 101/180 |
| 6,986,305 | B2 | | 1/2006 | Knauer | 101/220 |
| 6,997,108 | B2 | * | 2/2006 | Tabuchi et al. | 101/217 |
| 7,000,539 | B2 | * | 2/2006 | Hajek et al. | 101/217 |
| 7,032,510 | B2 | | 4/2006 | Christel et al. | 101/216 |
| 2002/0033105 | A1 | | 3/2002 | Charette et al. | 101/220 |
| 2002/0078840 | A1 | | 6/2002 | Gafney et al. | 101/217 |
| 2004/0083911 | A1 | | 5/2004 | Fujuwara | 101/247 |
| 2004/0206257 | A1 | | 10/2004 | Gaffney et al. | 101/217 |
| 2004/0237817 | A1 | | 12/2004 | Rauh | 101/218 |
| 2005/0160933 | A1 | | 7/2005 | Ruschowski | 101/425 |
| 2006/0150838 | A1 | * | 7/2006 | Hollings et al. | 101/180 |

FOREIGN PATENT DOCUMENTS

| | | | |
|---|---|---|---|
| DE | 3543704 | A1 | 6/1987 |
| DE | 3716188 | A1 | 12/1987 |
| DE | 4138479 | A1 | 6/1993 |
| DE | 4337554 | A1 | 6/1994 |
| DE | 4412873 | A1 | 11/1994 |
| DE | 9018111 | U | 6/1995 |
| DE | 4408025 | A1 | 9/1995 |
| DE | 4435429 | A1 | 4/1996 |
| DE | 19501243 | A1 | 7/1996 |
| DE | 4143597 | C2 | 6/1998 |
| DE | 19903847 | A1 | 8/2000 |
| DE | 19919272 | A1 | 11/2000 |
| DE | 10013979 | A1 | 12/2000 |
| DE | 10008936 | A1 | 8/2001 |
| EP | 0225509 | A2 | 6/1987 |
| EP | 0388740 | B1 | 9/1990 |
| EP | 0421145 | B2 | 4/1991 |
| EP | 0549936 | A1 | 7/1993 |
| EP | 0581019 | B1 | 2/1994 |
| EP | 0596244 | A1 | 5/1994 |
| EP | 0644048 | A2 | 3/1995 |
| EP | 0683043 | B1 | 11/1995 |
| EP | 0685335 | B1 | 12/1995 |
| EP | 0697284 | B1 | 2/1996 |
| EP | 0741015 | B1 | 11/1996 |
| EP | 0749927 | B1 | 12/1996 |
| EP | 0782920 | B1 | 7/1997 |

| | | | | |
|---|---|---|---|---|
| EP | 0813958 | B1 | | 12/1997 |
| EP | 0813959 | B1 | | 12/1997 |
| EP | 0845352 | A1 | | 6/1998 |
| EP | 0862999 | B1 | | 9/1998 |
| EP | 0956951 | B1 | | 11/1999 |
| EP | 0958917 | B1 | | 11/1999 |
| EP | 0995595 | B1 | | 4/2000 |
| EP | 1075943 | A1 | | 2/2001 |
| EP | 1075944 | B1 | | 2/2001 |
| EP | 1075945 | A1 | | 2/2001 |
| EP | 1132202 | B1 | | 9/2001 |
| EP | 1155825 | A2 | | 11/2001 |
| EP | 1167028 | A2 | | 1/2002 |
| FR | 2787059 | | | 6/2000 |
| GB | 2149149 | A | | 6/1985 |
| GB | 2 273 464 | | | 6/1995 |
| GB | 2309668 | A | | 8/1997 |
| JP | 63-236651 | | | 10/1988 |
| JP | 04371836 | A | * | 12/1992 |
| WO | WO 03/000496 | A1 | | 1/2003 |
| WO | WO 03/084757 | A1 | | 10/2003 |

OTHER PUBLICATIONS

Harris Corporation, The Harris M-112 and M-122: Profits through Automation, pp. 1-4.

Jochen Pagenberg; Johannes Lang, Le Droit Allemand Des Brevets Et Des Modeles D'Utilite.

Von Marcel Jacomet, Regeln und Steuern mit unscharfer Logik; pp. 94+.

Goss Sunday 2000 Automatic Transfer Provides Exclusive Zero-Makeready Advantages, Oct. 18, 2004 www.members.what-theythink.com/allsearch/article.cfm?id=17971&printer=pr.

Goss bietet Null-Rustzeiten-Vorteil, Oct. 2004, www.druckspiegel.de/archiv/news/2004/10/news.html.

Goss Sunday 2000 Automatic Transfer provides exclusive zero-makeready advantages, Oct. 10, 2004 www.gossinternational.com/index.php?src=news&prid=21&category=Commerical.

Heidelberg Introduces Web Offset Makeready Breakthrough, Feb. 6, 2004, pp. 1-3.

Web Offset, Issue No. 55, pp. 1-16, Published by Goss International Corporation 2004.

Rotoman S Printing Unit, 2005. www.man-roland.de/en/popups/pw0118/w0011/index.jsp.

* cited by examiner

WEB OFFSET PRINTING PRESS WITH AUTOPLATING

This application claims priority to U.S. Provisional Application No. 60/666,360 filed Mar. 30, 2005, and hereby incorporated by reference herein.

BACKGROUND

The present invention relates generally to printing presses and more specifically to web offset printing presses having separable blankets.

U.S. Pat. No. 4,240,346 describes for example a printing press with two blanket cylinders separable from each other to permit a blanket throw off. In such presses, the blankets are offset from a vertical from each other, and in order to pass the web through the blankets when the blankets are offset, lead rolls or air bars are necessary to properly guide the web through the blankets. These guides can mark the printed product and also alter registration of the web between two printing print units, causing deteriorated print quality.

U.S. Pat. Nos. 6,216,592 and 6,019,039 describe printing units with throw-off mechanisms and are hereby incorporated by reference herein.

SUMMARY OF THE INVENTION

The present invention provides an offset web print unit comprising:

a plate cylinder;

a blanket cylinder;

a second blanket cylinder;

an autoplating mechanism, and a throw-off mechanism including a single actuator both for moving the blanket cylinder from the second blanket cylinder and for moving the blanket cylinder to selectively contact the plate cylinder to permit autoplating while the blanket cylinder is thrown-off of the second blanket cylinder.

The present invention also provides a method for autoplating comprising throwing off a blanket cylinder from a second blanket cylinder using an actuator, separating a plate cylinder from the blanket cylinder using the actuator; and plating the plate cylinder with a printing plate, the plating step including removing a used printing plate from the blanket cylinder.

BRIEF DESCRIPTION OF THE DRAWINGS

Preferred embodiments of the present invention will be elucidated with reference to the drawings, in which.

DETAILED DESCRIPTION

Figure 1:
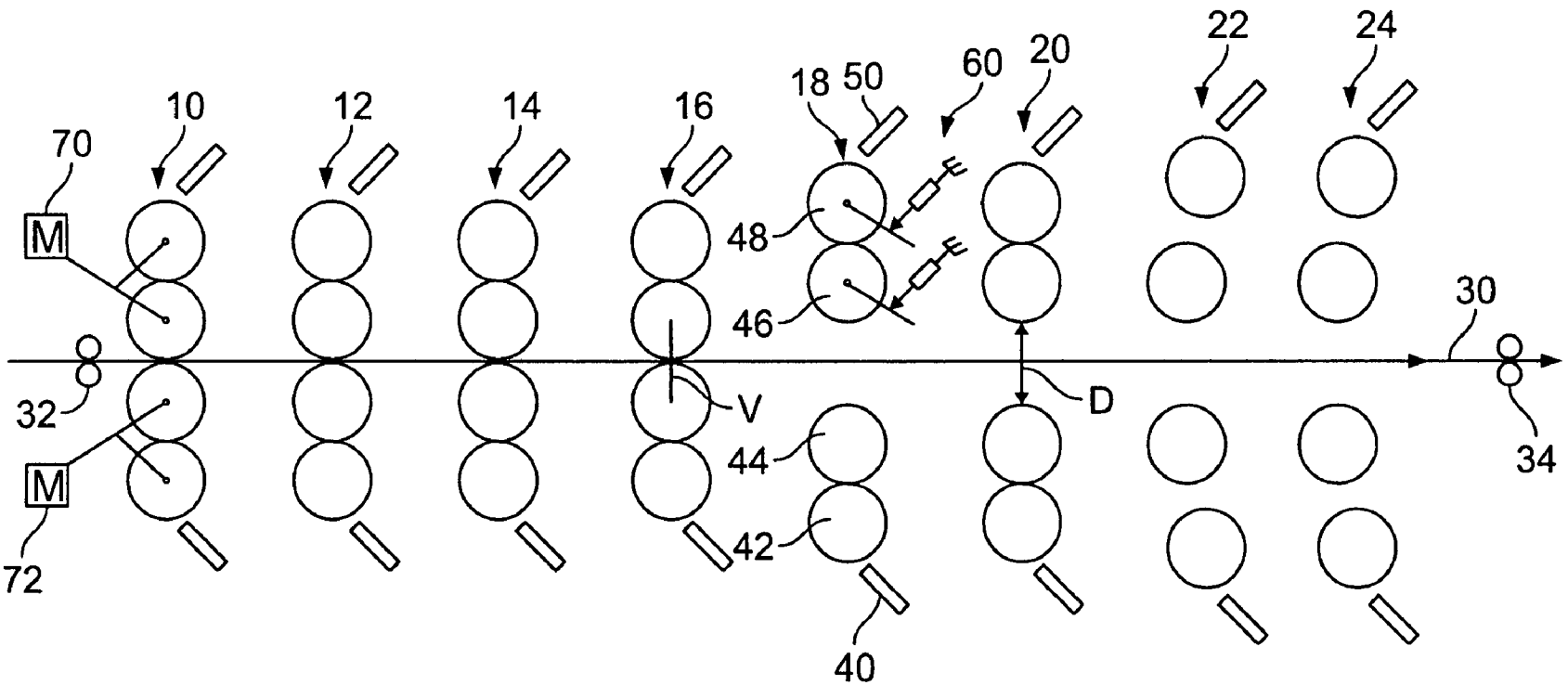
FIG. 1 shows a web offset printing press.

FIG. 1 shows a web offset printing press having eight offset print units 10, 12, 14, 16, 18, 20, 22, 24, each having a plate cylinder 42, blanket cylinder 44, plate cylinder 48 and blanket cylinder 46. Blanket cylinders 44 and 46 nip a web 30 in a printing mode, as shown for print units 10, 12, 14, 16, which may print black, cyan, yellow and magenta, respectively for example. The web may enter the print units via nip rollers 32 (which may be infeed rollers for example) and may exit via exit rollers 34, which may for example be located downstream of a dryer.

The blanket cylinders 44, 46 for each print unit may be thrown-off, as shown for units 22 and 24, so as to separate from each other and from the respective plate cylinder 42, 48. Plate cylinders 42, 48 may move back into contact with the blanket cylinders 44, 46, respectively, during an automatic plate change operation, for example via automatic plate changers 40 and 50, respectively. Automatic plate changers are described in U.S. Pat. Nos. 6,053,105, 6,460,457 and 6,397,751 and are hereby incorporated by reference herein.

A throw-off mechanism 60 is shown schematically for moving the blanket and plate cylinders 46, 48. Blanket cylinder 44 and plate cylinder 42 may have a similar throw-off mechanism. Preferably, each print unit is driven by two motors 70, 72, one driving one of the plate or blanket cylinders 46, 48, and one driving one of the plate cylinder 42 and blanket cylinder 44. The non-driven cylinder may be geared to the driven cylinder on each side of web 30. Each print unit 10, 12 . . . 24 may be the same.

The web path length between the nip rollers 32, 34 advantageously need not change, even when one of the print units has blanket cylinders which are thrown off. Registration may be unaffected by the throw-off. In addition, no web deflectors or stabilizers are needed, such as lead rolls or air rolls to make sure the web does not contact the blanket cylinders 44, 46, which could cause marking.

The throw-off distance D preferably is at least 0.5 inches and most preferably at least 1 inch, i.e. that the web has half an inch clearance on either side of the web. Moreover, the centers of the blanket cylinders 44, 46 preferably are in a nearly vertical plane V, which is preferably 10 degrees or less from perfect vertical. This has the advantage that the throw-off provides the maximum clearance for a horizontally traveling web.

The circumference of the plate cylinder preferably is less than 630 mm, and most preferably is 578 mm.

Figure 2:
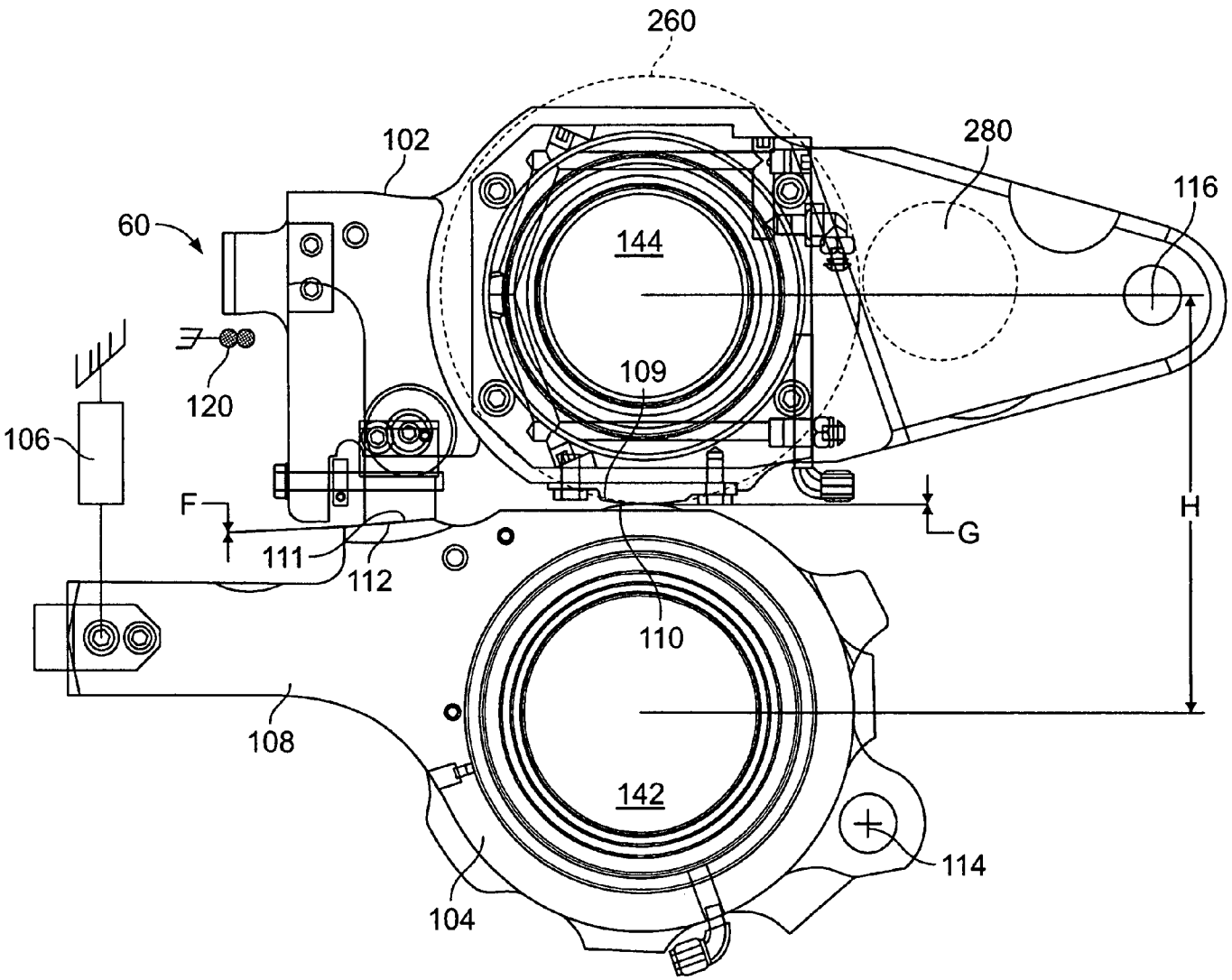
FIG. 2 shows bearer cams for a lower print couple in a first printing position.

The creation of the large throw-off distance D is explained with an exemplary embodiment as follows:

FIG. 2 shows the throw-off mechanism 60 for the lower blanket cylinder 44. A blanket cylinder support 102 supports a gear side axle 144 of the blanket cylinder 44 and a plate cylinder support 104 supports a gear side axle 142 of the plate cylinder 42. The blanket cylinder support 102 is pivotable about an axis 116, and the plate cylinder support about an axis 114. A pneumatic cylinder 106 can move the plate cylinder support 104 via an arm 108.

When blanket cylinder 44 is in contact with blanket cylinder 46 in a printing position, a first bearer surface 111 of support 102 is in contact with a second bearer surface 112 of support 104, which another bearer surface 109 of the support 102 is not in contact with a bearer surface 110 of support 104. Distance F thus is zero, while a distance G between surfaces 109 and 110 may be 0.0045 inches. Distance H between the axial centers of the axles 144 and 142 may be 7.2463 inches.

Figure 3:
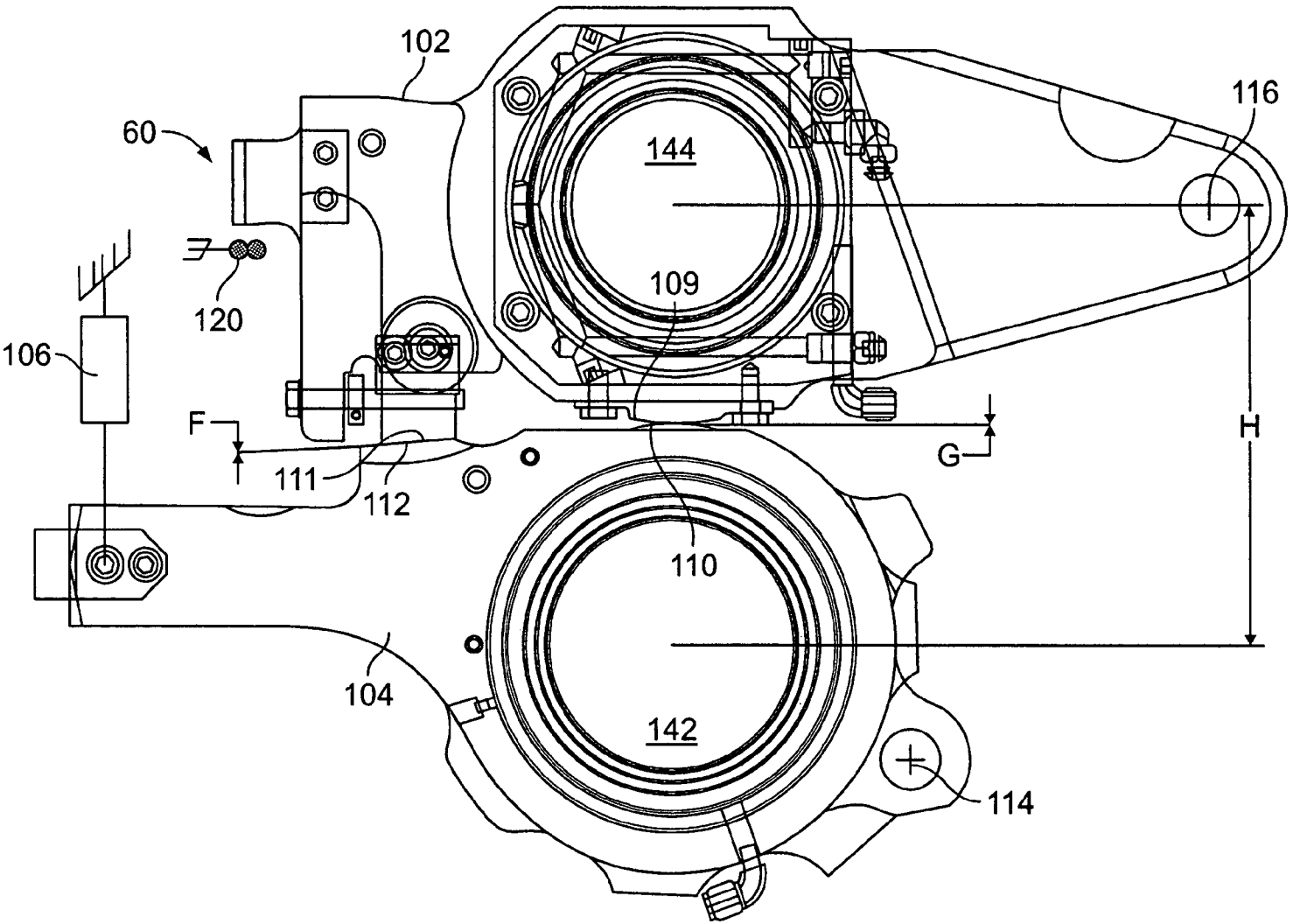
FIG. 3 shows bearer cams in a transition position.

In FIG. 3, support 104 is moved downwardly so distance H maybe for example 7.2416 inches, and the distances F and G both are zero. The cam surfaces 111, 112 and 109, 110 thus are transitioning the load between themselves.

Figure 4:
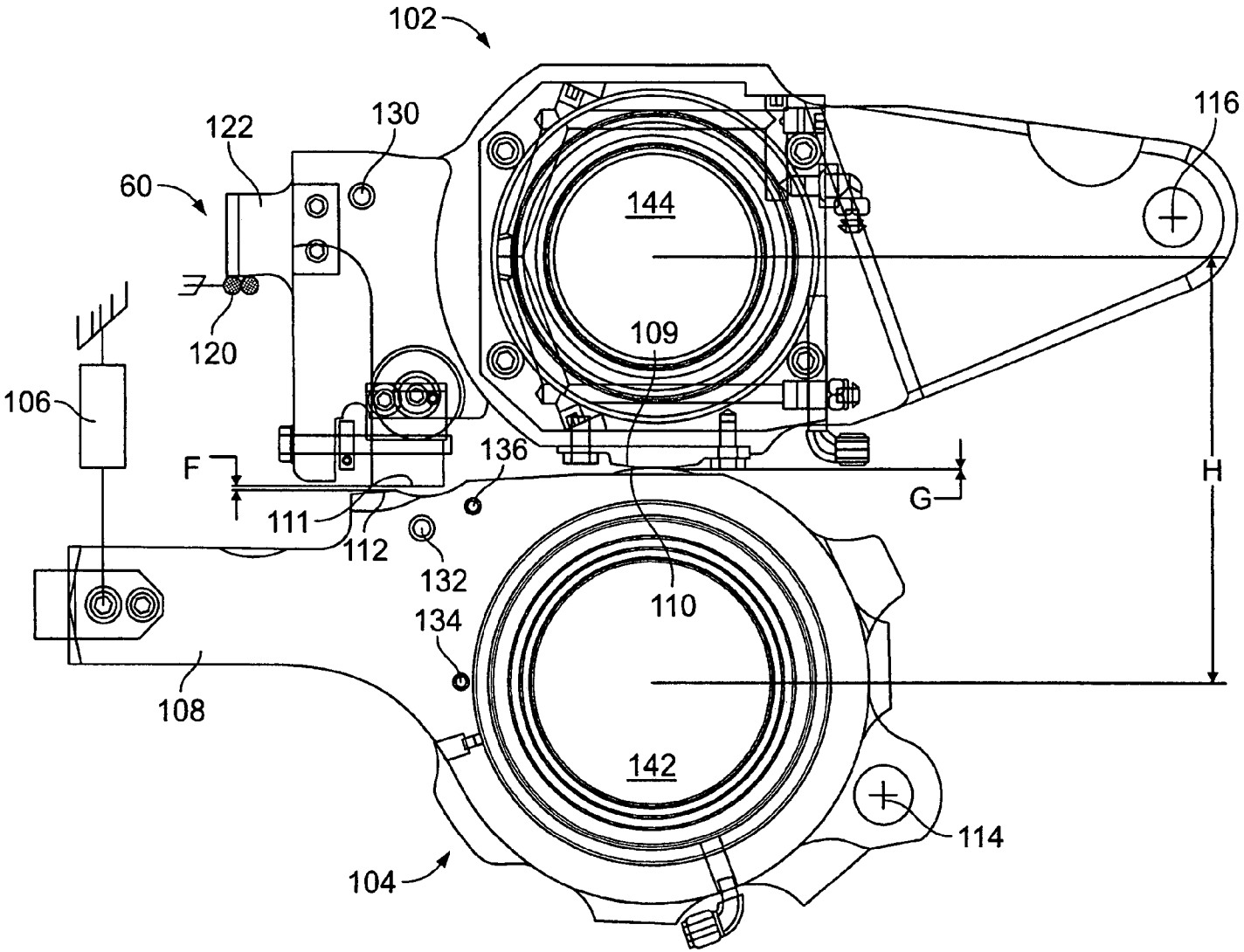
FIG. 4 shows bearer cams in a first throw-off position with the plate and blanket cylinders in contact.

As shown in FIG. 4, when support 104 moves downwardly more, blanket cylinder 44 is thrown-off the blanket cylinder 46, bearer surface or cam 109 of support 102 contacts bearer surface 110 of the box 104 so that the blanket cylinder box 102 rests on the box 104 at surfaces 109/110. A distance between the bearer surface 111 of box 102 and a bearer surface 112 of box 104 may be 0.1561 inches. The bearer surface 109 may have a same arc of curvature as blanket cylinder 44, and bearer surface 110 may have a same arc of curvature as plate cylinder 42, so that even in FIG. 4 distance H still remains 7.2416 inches. At this point an extension 122 also just comes into contact with a fixed stop 120 on a frame.

Figure 5:
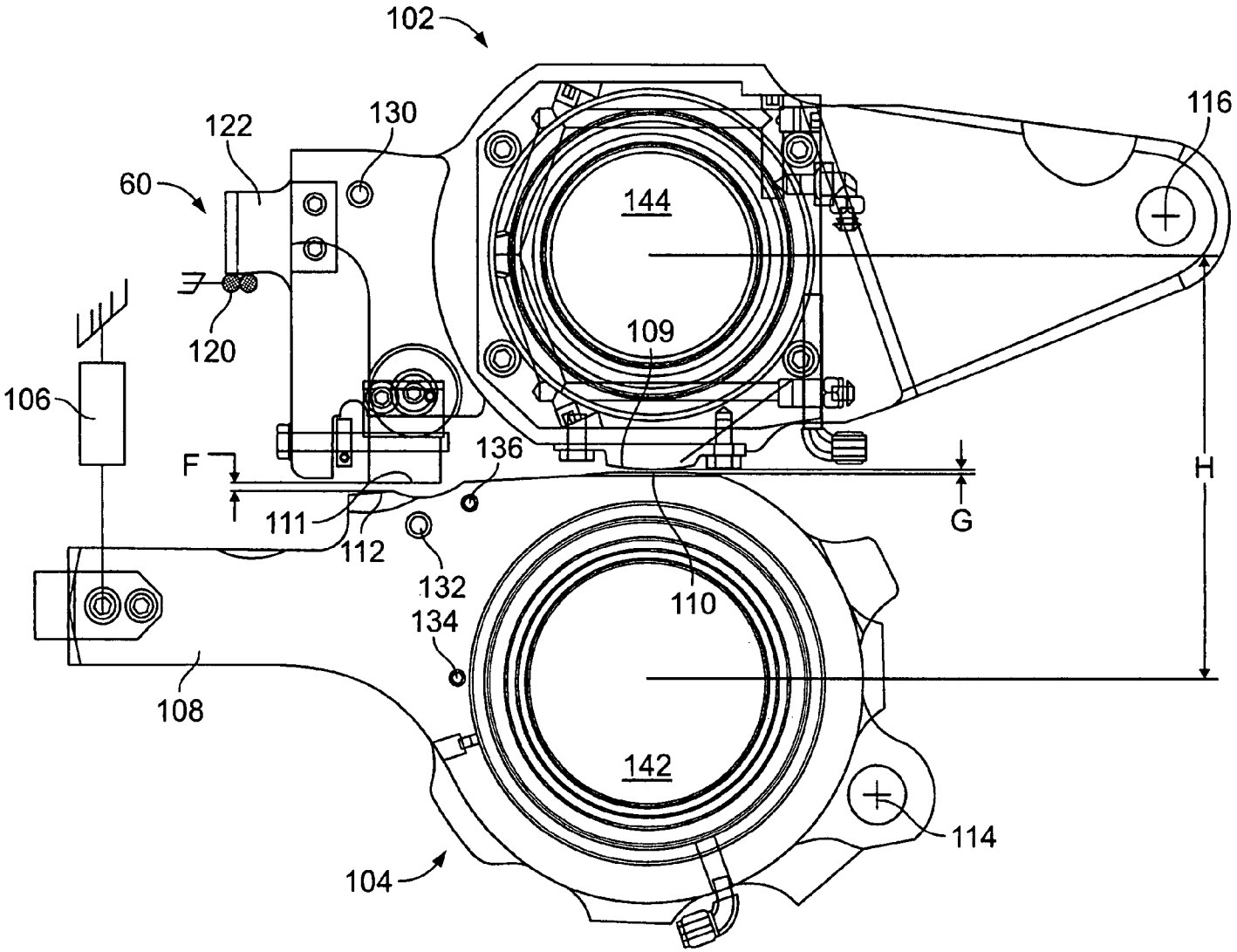
FIG. 5 shows bearer cams in a second throw-off position with the plate and blanket cylinders out of contact.

As shown in FIG. 5, when support 104 is moved downwardly more, blanket support 102 rests on stop 120 while plate support 104 moves downwardly even more. Thus, distance G between bearer surfaces 109 and 110 increases and may be 1 mm, for example. Distance F also increases. In this position, access to plate cylinder 42 for removing or changing a plate may be possible. For autoplating, the plate cylinder 42 may be moved again against the blanket cylinder 44 as in FIG. 4, if the autoplating mechanism so requires.

The upper plate and blanket throw-off mechanism also have dual bearer surfaces, but since the gravity effects differ, a link can be provided between similar holes 130, 132 in the upper supports so that the raising of the plate cylinder 48 also causes the blanket cylinder 46 to rise.

Figure 6:
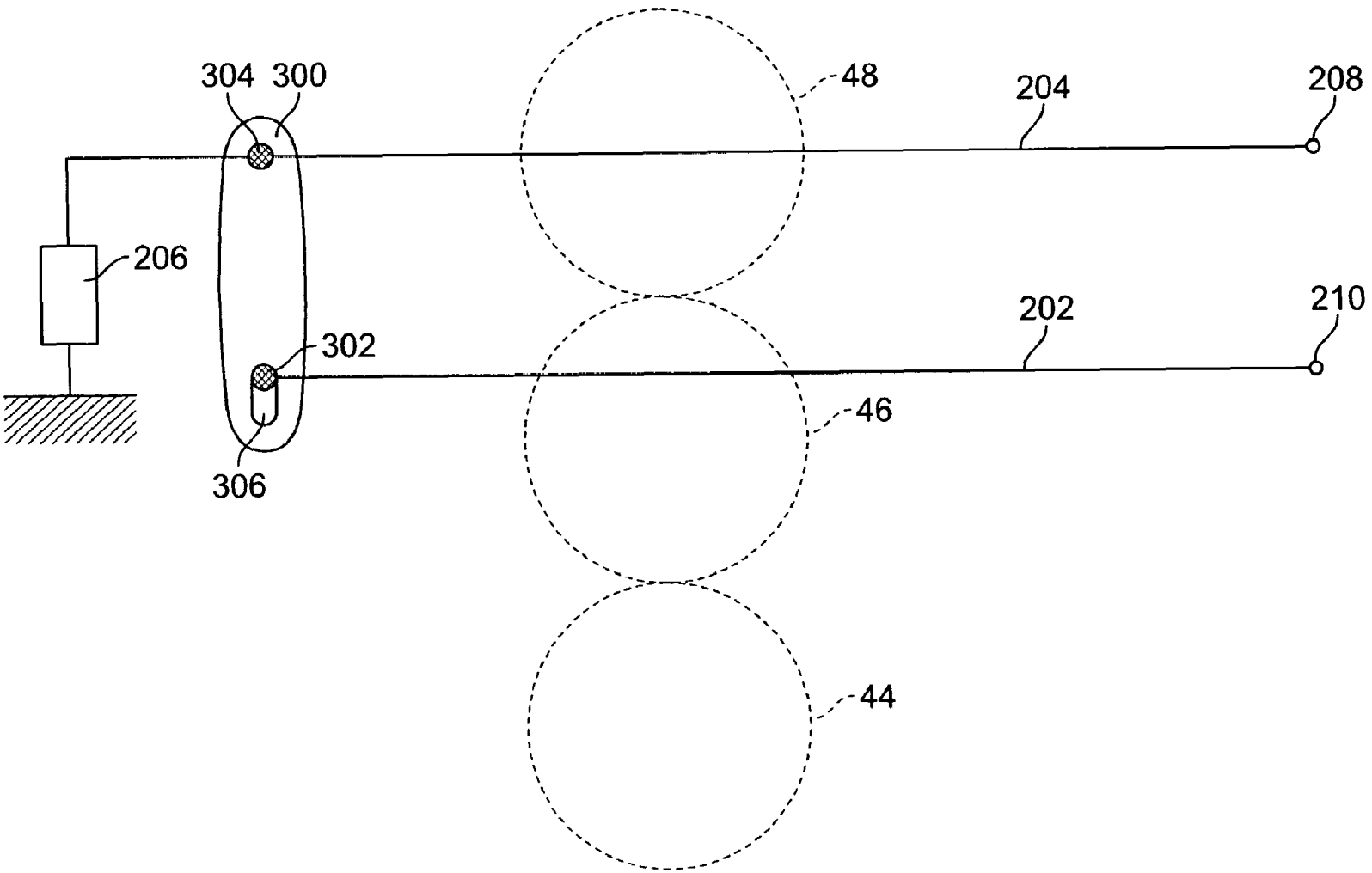
FIG. 6 shows schematically supports for an upper print couple in a printing position.

FIG. 6 shows schematically blanket cylinder support 202 and plate cylinder support 204 for the upper print couple 46, 48 in a printing position. A link 300 connects the supports 204 202 via pins 304 and 302. Pin 304 may be rotatable but does not permit translational movement of link 300 with respect to support 204. Pin 302 however is located in an elongated slot 306 of link 300 to permit some translational movement as will be described. An acutator 206 (which preferably is a device separate from actuator 106 but may be links connected to actuator 106) can rotate support 204 about a pivot 208.

Figure 7:
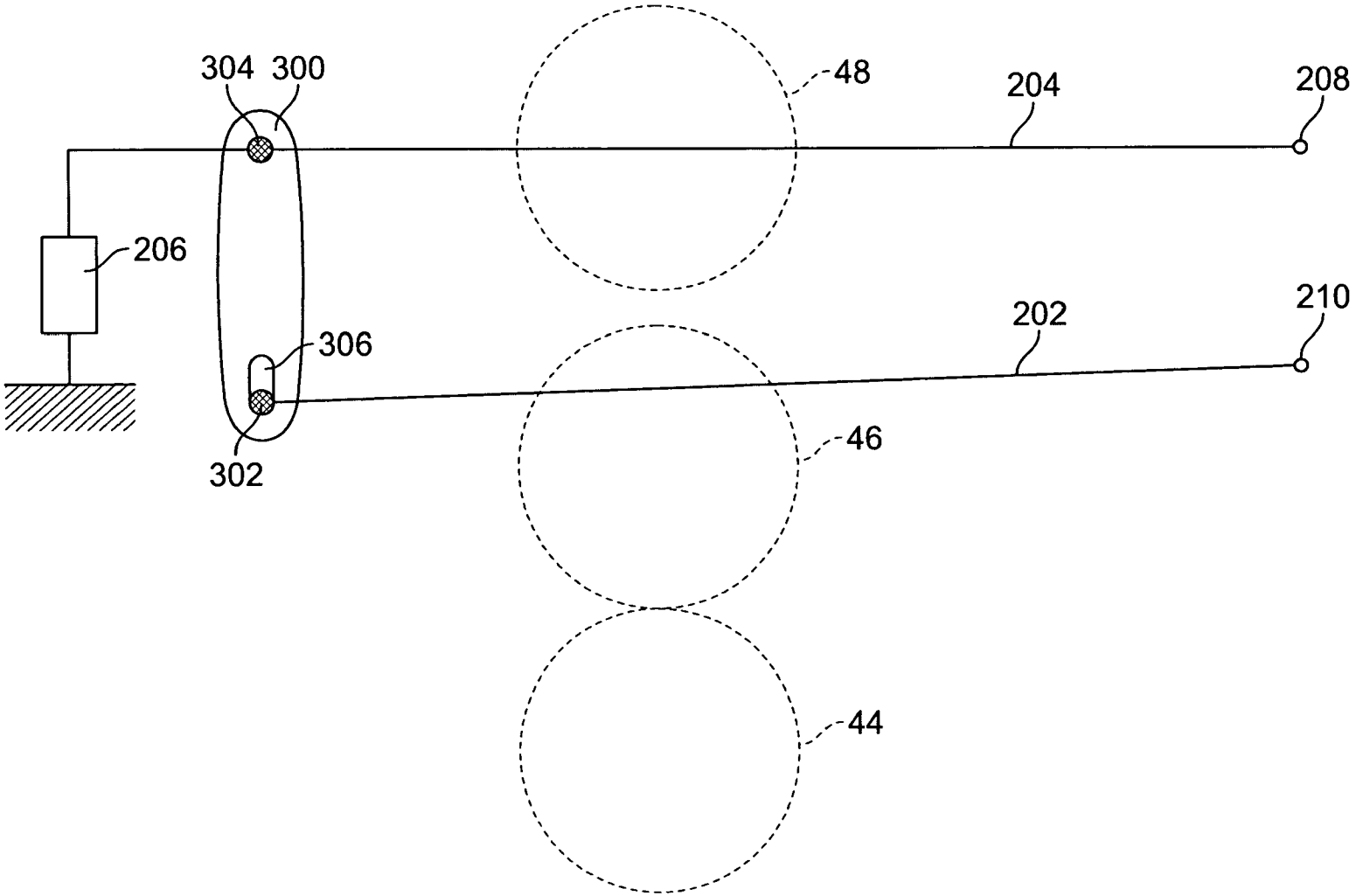
FIG. 7 shows the supports of FIG. 6 with the plate cylinder 48 moved away from blanket cylinder 46.

FIG. 7 shows the actuator 206 moving the plate cylinder 48 upwardly via support 204. Link 300 and slot 306 move to upwardly as well, but support 202 does not move as the pin 302 is not pulled upwardly due to the slot 306. The plate cylinder 48 moves away from blanket cylinder 46.

Figure 8:
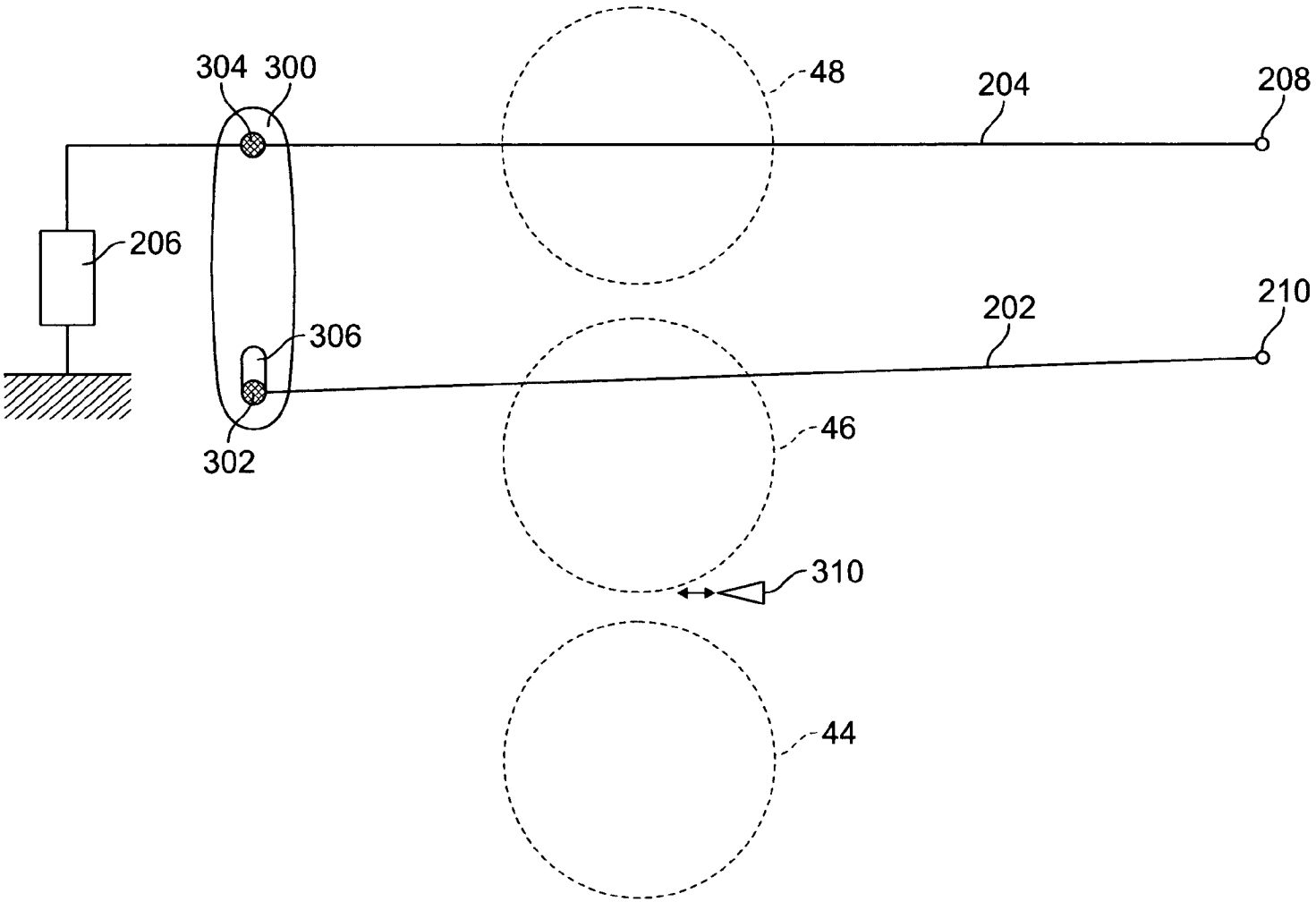
FIG. 8 shows the supports of F*ig*.6 with the blanket cylinder 46 thrown off blanket cylinder 44, and plate cylinder 48 apart from blanket cylinder 46.

FIG. 8 shows the actuator 206 moving the plate cylinder support 204 even further upwardly and now the bottom of slot 306 pulls pin 302 upwardly to lift support 202 about pivot 210. The blanket cylinder 46 is thus thrown off blanket cylinder 44, and plate 48 is apart from blanket cylinder 46.

A wedge 310 can move under support 202 in this position to support blanket support 202 and blanket cylinder 46 in the thrown off position.

Figure 9:
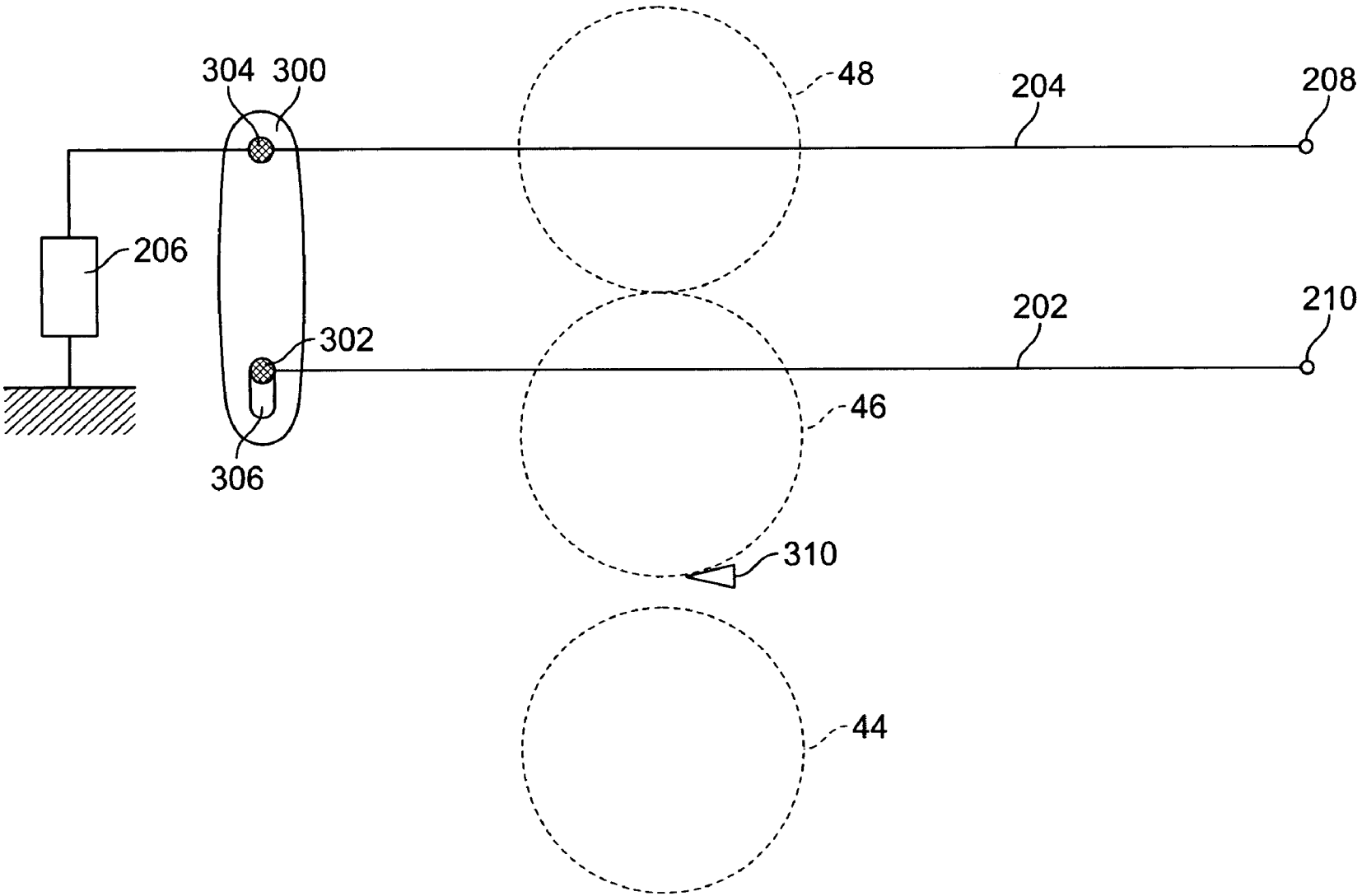
FIG. 9 shows the support of FIG. 6 with the blanket cylinder 46 thrown off but contacting plate cylinder 48.

As shown in FIG. 9, the plate cylinder 48 can then contact the blanket cylinder 46 by having the actuator 206 move the support 204 downwardly while wedge 310 supports support 202. FIG. 9 shows the support of FIG. 6 with the blanket cylinder 46 thrown off but contacting plate cylinder 48.

As shown in FIG. 2, a drive gear 280 may drive a blanket cylinder gear 260. The blanket cylinder gear 260 may drive a similar plate cylinder gear. These gears 280, 260 may be axially inside the support 102, i.e. into the page. Due to the tangential arrangement of the gears, the rotation of the support 102 does not cause the gear 260 to disengage from gear 280 (which has an axis which does not translate). In the FIGS. 2, 3, 4, and 5 positions, the blanket cylinder gear 260 and an interacting plate cylinder gear can be driven by gear 280. The motor 72 thus can be used for auto-plating.

The present invention thus provides for large movement of the blanket and plate cylinders in an effective manner while maintaining auto-plating capability.

What is claimed is:

1. An offset web printing press comprising:
a first print unit; and
a second print unit;
the first print unit including:
a plate cylinder;
a first blanket cylinder;
a second blanket cylinder;
a motor driving the plate cylinder and first blanket cylinder in a printing position;
an autoplating mechanism; and
a throw-off mechanism including a single actuator moving the first blanket cylinder from the second blanket cylinder and moving the first blanket cylinder to selectively contact or be apart from the plate cylinder, the throw-off mechanism defining a first throw-off position where the first blanket cylinder and the plate cylinder are in contact but the first blanket cylinder is apart from the second blanket cylinder so that the motor can drive the plate cylinder and the first blanket cylinder to permit autoplating and a second throw-off position where the first blanket cylinder is apart from the second blanket cylinder and from the plate cylinder,
the second print unit including:
a further plate cylinder located downstream of the plate cylinder;
a further blanket cylinder located downstream of the first blanket cylinder, the further plate cylinder and further blanket cylinder printing on a same side of a web as the plate cylinder and first blanket cylinder; and
a further motor driving the further plate cylinder and further blanket cylinder in a printing position.

2. The offset web printing press as recited in claim 1 further comprising a blanket support for supporting an end of the first blanket cylinder and a plate support for supporting an end of the plate cylinder.

3. The offset web printing press as recited in claim 2 further comprising a frame stop for stopping a movement of the blanket support during throw off so that the plate cylinder moves apart from the first blanket cylinder supported by the blanket support.

4. The offset web printing press as recited in claim 2 further comprising a link connecting the blanket support and the plate support.

5. The offset web printing press as recited in claim 1 further comprising a second plate cylinder to selectively contact or be apart from the second blanket cylinder.

6. The offset web printing press as recited in claim 5 further comprising a second autoplating mechanism, the autoplating mechanism autoplating the first plate cylinder and the second autoplating mechanism autoplating the second plate cylinder.

7. The offset web printing press as recited in claim 5 wherein the plate cylinder and first blanket cylinder are driven by a first motor and the second blanket cylinder and second plate cylinder are driven by a second motor.

8. The offset web printing press as recited in claim 1 wherein the first blanket cylinder is moved so the first blanket cylinder is at least 0.5 inches from the second blanket cylinder during throw off

9. The offset web printing press as recited in claim 8 wherein the first blanket cylinder is moved so the first blanket cylinder is 1.0 inches from the second blanket cylinder during throw off.

10. The offset web printing press as recited in claim 1 wherein a center of the first blanket cylinder and a center of the second blanket cylinder are 10° or less from a vertical axis after throw-off.

11. The offset web printing press as recited in claim 1 further comprising a wedge, the first blanket cylinder being selectively supportable by the wedge.

12. The offset web printing press as recited in claim 11 wherein the wedge is movable.

13. A method for autoplating an offset web printing press and printing comprising the steps of:

throwing off a first blanket cylinder from a second blanket cylinder using an actuator;

throwing off a third blanket cylinder from a fourth blanket cylinder using a second actuator, the third and fourth blanket cylinders located downstream of the first and second blanket cylinders;

separating a plate cylinder from the first blanket cylinder and contacting the plate cylinder with the first blanket cylinder using the actuator when the first and second blanket cylinders are thrown off;

separating a second plate cylinder from the third blanket cylinder and contacting the second plate cylinder with the third blanket cylinder using the second actuator when the third and fourth blanket cylinders are thrown off;

automatically plating the plate cylinder with a printing plate by driving the plate cylinder with a motor that drives the plate cylinder and blanket cylinder during a printing process;

automatically plating the second plate cylinder with a second printing plate by driving the second plate cylinder with a second motor that drives the second plate cylinder and third blanket cylinder during a printing process; and printing a web using the plate cylinder and second plate cylinder.

14. The method for autoplating an offset web printing press and printing as recited in claim 13 wherein the plating step includes removing a used printing plate from the plate cylinder.

15. The method for autoplating an offset web printing press and printing as recited in claim 13 wherein the step of separating a plate cylinder includes stopping a movement of a blanket support during throw off so that the plate cylinder moves apart from the first blanket cylinder supported by the blanket support.

16. The method for autoplating an offset web printing press and printing as recited in claim 13 wherein the step of throwing off a first blanket cylinder from a second blanket cylinder includes a throw off distance of at least 0.5 inches.

17. The method for autoplating an offset web printing press and printing as recited in claim 16 wherein the step of throwing off a first blanket cylinder from a second blanket cylinder includes a throw off distance of at least 1.0 inches.

18. The method for autoplating an offset web printing press and printing as recited in claim 13 wherein after the step of throwing off a center of first blanket cylinder and a center of second blanket cylinder are 10° or less from a vertical axis.

19. An offset web print unit comprising:

a plate cylinder;

a first blanket cylinder;

a second blanket cylinder;

an autoplating mechanism;

a throw-off mechanism including a single actuator moving the first blanket cylinder from the second blanket cylinder and moving the first blanket cylinder to selectively contact or be apart from the plate cylinder to permit autoplating while the first blanket cylinder is thrown-off of the second blanket cylinder; and a link connecting the blanket support and the plate support, wherein the link includes a slot for translational movement.

* * * * *

UNITED STATES PATENT AND TRADEMARK OFFICE

CERTIFICATE OF CORRECTION

PATENT NO. : 7,516,698 B2
APPLICATION NO. : 11/388601
DATED : April 14, 2009
INVENTOR(S) : Brian Joseph Gentle et al.

It is certified that error appears in the above-identified patent and that said Letters Patent is hereby corrected as shown below:

Please replace "blanket" with "plate" at column 1, line 45:

> "The present invention also provides a method for autoplating comprising throwing off a blanket cylinder from a second blanket cylinder using an actuator, separating a plate cylinder from the blanket cylinder using the actuator; and plating the plate cylinder with a printing plate, the plating step including removing a used printing plate from the ~~blanket~~ plate cylinder."

In the claims, please add "a blanket support for supporting an end of the first blanket cylinder and a plate support for supporting an end of the plate cylinder;" before "and" in claim 19, at column 6, line 35:

> "19. An offset web print unit comprising:
> a plate cylinder;
> a first blanket cylinder;
> a second blanket cylinder;
> an autoplating mechanism;
> a throw-off mechanism including a single actuator moving the first blanket cylinder from the second blanket cylinder and moving the first blanket cylinder to selectively contact or be apart from the plate cylinder to permit autoplating while the first blanket cylinder is thrown-off of the second blanket cylinder;
> a blanket support for supporting an end of the first blanket cylinder and a plate support for supporting an end of the plate cylinder; and
> a link connecting the blanket support and the plate support, wherein the link includes a slot for translational movement."

Signed and Sealed this

Twenty-seventh Day of October, 2009

David J. Kappos

David J. Kappos
*Director of the United States Patent and Trademark Office*